United States Patent [19]

Leininger

[11] 4,170,867

[45] Oct. 16, 1979

[54] SPUN-LIKE CONTINUOUS MULTIFILAMENT YARN

[75] Inventor: James C. Leininger, Greenville, S.C.

[73] Assignee: Phillips Petroleum Company, Bartlesville, Okla.

[21] Appl. No.: 881,478

[22] Filed: Feb. 27, 1978

[51] Int. Cl.[2] ..... D02G 3/04; D02G 3/24

[52] U.S. Cl. ..... 57/245; 57/247

[58] Field of Search ..... 57/140 BY, 140 R, 140 T, 57/243, 244, 245, 246, 247

[56] References Cited

U.S. PATENT DOCUMENTS

| | | | |
|---|---|---|---|
| 3,199,281 | 8/1965 | Maerov et al. | 57/140 BY |
| 3,255,580 | 6/1966 | Garner et al. | 57/140 BY |
| 3,780,515 | 12/1973 | Waters | 57/157 R |
| 3,824,776 | 7/1974 | London, Jr. | 57/140 J |
| 3,877,213 | 4/1975 | MacFarlane | 57/140 R |
| 3,936,996 | 2/1976 | Schiffer | 57/140 BY X |

*Primary Examiner*—Charles Gorenstein

[57] ABSTRACT

A process for producing a continuous multifilament yarn of melt-spinnable, polymeric material comprising simultaneously draw texturing two partially oriented feeder yarn ends having different molecular orientation due to their respective spinning operations, including plying the two yarn ends together, friction texturing and air jet interlacing the resulting composite yarn. Also disclosed is the spun-like continuous multifilament yarn produced by the disclosed process as well as the resulting fabric made from the yarn. The yarn has components of differing crimp amplitude and frequency.

24 Claims, 7 Drawing Figures

SPUN-LIKE CONTINUOUS MULTIFILAMENT YARN

Figure 1:
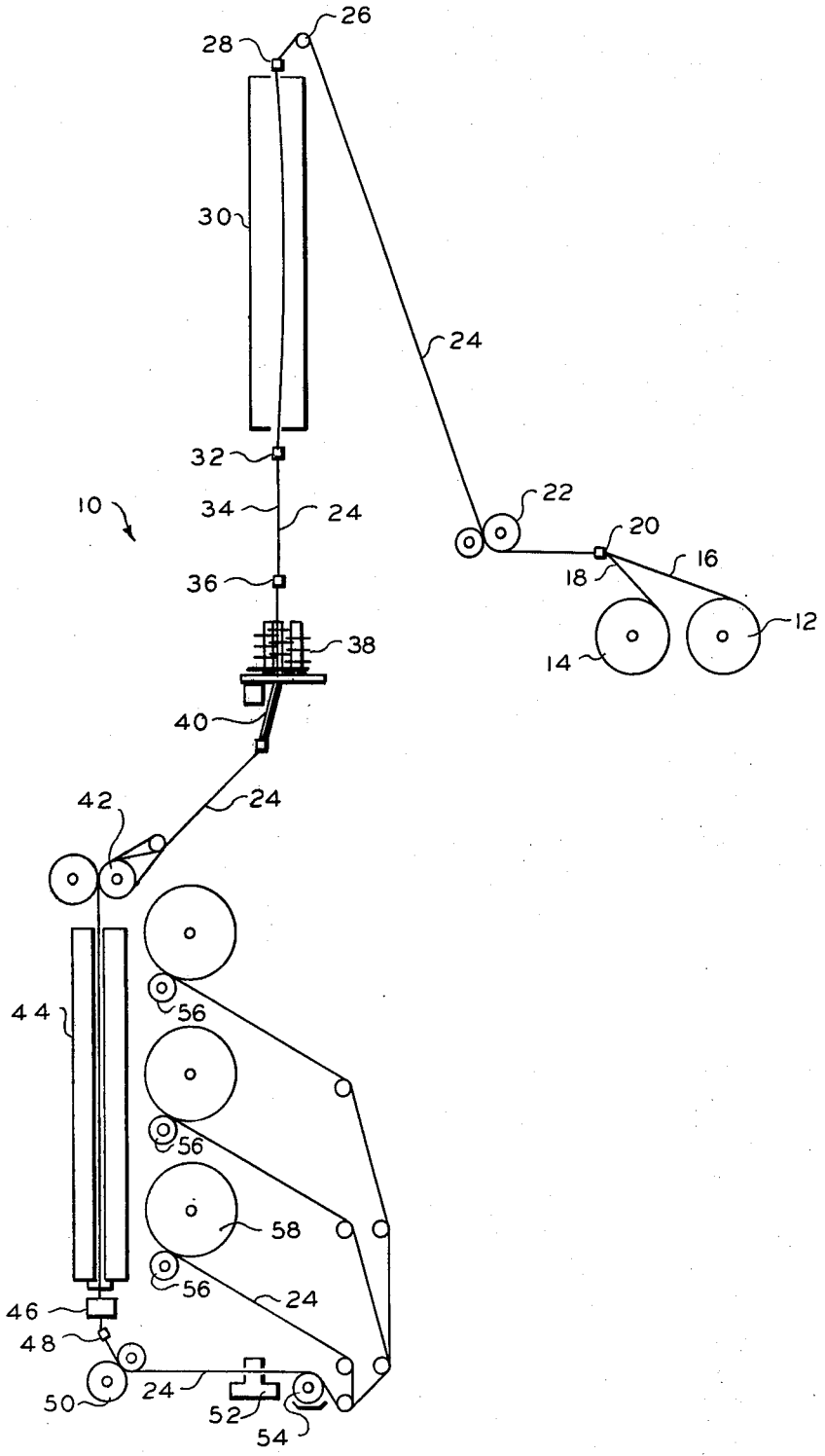

This invention relates to the production of yarn. In one aspect it relates to a novel process for the production of continuous filament yarn. In another aspect it relates to a novel yarn produced by the novel process. In yet another aspect the invention relates to a novel fabric made from the novel yarn.

There has been an accelerating trend toward a spun yarn look in outer wear recently, as evidenced by numerous articles in trade publications and reduced sales of continuous filament polyester. For some time, the textile industry has sought ways of producing yarns from continuous filaments such that the yarns have the characteristics of a spun yarn comprising staple and can be woven into fabric having a spun yarn look. Prior to the development of synthetic filaments, all yarns were produced from staple products. Synthetic filaments, however, are manufactured in the form of continuous filaments and, in order to provide the desirable effects of staple products, a vast proportion of synthetic filament production has been cut into staple length fibers, which fibers are then twisted into yarns called spun yarns.

Spun yarns have a particularly desirable characteristic of being somewhat fuzzy along their length, giving them the desirable attributes of softness and cover and, when woven into fabrics, the ability to produce low density, porous, permeable and comfortable materials. Continuous filament yarns also have many desirable attributes but these are accompanied by limitations, particularly with respect to bulk, cover and comfort factors. It is well known, however, that continuous filament yarns have replaced spun yarns for many end uses.

It is readily apparent that, if a continuous filament yarn can be made into a spun-like yarn, the otherwise expensive steps of cutting continuous fibers into staple followed by opening, picking, carding, drawing and twisting into roving, followed by drafting and twisting further in the yarns could be eliminated. Many attempts have been made to accomplish this feat but various limitations in the resulting products have prevented such continuous filament yarns from completely replacing spun yarns.

It would thus be advantageous to produce a simulatd spun-like yarn which is made from continuous filaments and which does not have the disadvantages of the prior art.

In accordance with the present invention it has been discovered that a spun-like, continuous synthetic filament yarn, which can be woven, knitted or otherwise made into a fabric having a spun-like appearance, can be produced by simultaneously draw texturing two polyester continuous filament yarns of different molecular orientation under operating conditions which produce a higher degree of texture in one yarn than in the other.

It is an object of the present invention to produce a textured continuous filament yarn of melt-spinnable polymer material with spun-like yarn appearance and feel.

It is another object of the present invention to provide a process for the production of a textured continuous filament yarn of melt-spinnable polymer material with spun-like yarn appearance and feel.

It is yet another object of the present invention to produce a fabric made from a spun-like continuous filament yarn which fabric exhibits a spun-like appearance.

Other aspects, objects and advantages of the invention will be evident from the following detailed description when read in conjunction with the accompanying drawings in which:

FIG. 1 is a schematic diagram illustrating the process of the present invention; and FIGS. 2, 3, 4, 5, 6 and 7 are photographs of yarns produced in accordance with the present invention.

More specifically, in accordance with the invention there is provided a process for producing a continuous multifilament yarn comprising simultaneously draw texturing two partially oriented feeder yarns having different amounts of molecular orientation imparted thereto during the spinning operation. These two yarns are plied together from the creel of a texturing machine and subsequently friction textured as one yarn through a friction aggregate, heated and air jet interlaced to produce a spun-like yarn. A predetermined length of continuous multifilament yarn produced by this process comprising a first component yarn having at least one first draw textured filament, each first filament having a first crimp amplitude, a first crimp frequency and a first length; a second component yarn having at least one second draw textured filament, each second filament having a second crimp amplitude, a second crimp frequency and a second length, the second crimp amplitude being less than the first crimp amplitude, the second crimp frequency being greater than the first crimp frequency, and the second length being greater than said first length; and the second component yarn being randomly distributed along and about the first component yarn substantially free of any reversing helices of the second component yarn whereby the continuous multifilament yarn formed thereby exhibits the effective appearance of a yarn spun from staple fibers. A fabric exhibiting a spun-like appearance and made from the continuous multifilament yarn is also provided in accordance with this invention.

Referring now to FIG. 1, apparatus is schematically depicted therein for the production of the continuous multifilament yarn of the present invention and is generally designated by the reference character 10. It is presently preferred to employ a slightly modified Scragg SDS-II draw texturing machine as the apparatus 10. This unit is manufactured by Ernest Scragg and Sons Limited, P.O. Box 16, Sunderland Street, Macclesfield, England.

As employed in the present manufacturing process, the apparatus 10 includes a creel which will simultaneously accommodate at least two yarn supply packages 12 and 14. The packages 12 and 14 supply first and second component yarns 16 and 18, respectively, through a suitable guide 20 to an input feed roll system 22 as a composite yarn 24. The yarn 24 is directed from the input feed roll system 22 through guides 26 and 28 and down over a curved heater plate in the primary heater assembly 30. The yarn 24 moves from the heater assembly 30 through a guide 32 into a cooling zone 34. From the cooling zone 34 the yarn 24 moves through a guide 36 and continues through a multi-disc friction twist unit or friction aggregate 38 of the general type described and illustrated in U.S. Pat. No. 3,885,378. The presently preferred friction twist unit is known under the registered trademark Positorq and is well known to those skilled in the yarn friction-twisting art.

The twisted yarn 24 is directed from the friction twist unit through a guide tube 40 to an intermediate feed roll or draw roll system 42. From the intermediate feed roll system 42, the twisted yarn passes directly through a final heating block 44. The heated and twisted yarn 24 passes from the final heating block 44 through a jet entangler 46 and thence through a guide 48 into an output roll system 50 during which time the yarn is heat-set. From the output roll system 50 the yarn 24 is directed through a yarn end break detector 52 and a yarn oiling sytem 54 to a selected one of three takeup yarn winding heads 56 where the yarn 24 is wound on a suitable takeup tube to form a yarn package 58.

The first and second component yarns 16 and 18 are preferably continuous multifilament yarns formed of a suitable melt-spinnable polymeric material. The presently preferred melt-spinnable polymeric material is polyethylene terephthalate, however it will be understood that either or both of the component yarns may be formed of other suitable melt-spinnable polymeric materials such as polyamides, polyolefins, or the like. Both component yarns are partially drawn or partially oriented. The component yarns are selected such that their molecular orientations are substantially different. This difference in molecular orientation can be achieved by variations in spinning rate and/or draw ratio during the spinning of the yarn. The molecular orientation of the component yarns is evidenced by the birefringence thereof. The measurement of birefringence in yarn is a technique well known to those skilled in the art and is described in "Fibers From Synthetic Polymers" by R. Hill (Elsevier Publishing Co., New York, 1953) at pages 266 to 268.

Polyester yarns suitable for the first yarn component are produced at a spinning speed in the range of from about 2200 meters per minute to about 3200 meters per minute, while suitable polyester yarns for the second yarn component are produced at a spinning speed in the range of from about 1800 meters per minute to about 2500 meters per minute. The spinning speed of the first component yarn should be at least approximately 235 meters per minute greater than the spinning speed of the second component yarn. Preferably, spinning speeds of the first and second component yarns are approximately 2735 meters per minute and approximately 1800 meters per minute, respectively, thus providing a spinning speed difference of approximately 935 meters per minute. It will be understood that the spinning speed referred to herein is based on the takeup speed at the winder in the spinning process.

The birefringence of the first component yarn is preferably within the range from about 0.018 to about 0.030, and is more preferably approximately 0.027. The birefringence of the second component yarn is preferably within the range of about 0.011 to about 0.025, and, more preferably, approximately 0.011. The birefringence difference between the first component yarn and the second component yarn is preferably at least 0.005 and, more preferably, is approximately 0.016.

The denier of the first component yarn is preferably in the range from about 100 to about 355, and, more preferably, is approximately 290. The second component yarn has a denier also preferably in the range of from about 100 to about 355, and, more preferably, has a denier of 260. The deniers of the first and second component yarns can be the same or different.

As mentioned above, the first and second component yarns can be suitably formed of a melt-spinnable polymer selected from the group consisting essentially of polyesters, polyamides, polyolefins and mixtures thereof, while a presently preferred melt-spinnable polymer is polyethylene terephthalate.

The composite yarn 24 is directed over the curved heater plate in the primary heater 30 which is preferably maintained at a temperature of approximately 210° C. The draw ratio of the composite yarn comprising the first and second component yarns in the apparatus 10 is preferably within the range from about 1.649 to about 2.294, and is more preferably approximately 1.984. The draw ratio referred to herein is the ratio of the linear speed of the intermediate feed roll system 42 to the linear speed of the input feed roll system. A yarn speed of approximately 325 meters per minute through the draw-texturing apparatus 10 at the takeup yarn winding head 56 provides good results. The ratio of the peripheral speed of the twisting device 38 to the yarn speed through the apparatus 10 is preferably within the range from about 1.59 to about 1.86, and, more preferably, is approximately 1.71.

The stabilizing overfeed of the twisted and textured yarn in the area of the final heating block 44 is preferably within the range of about 4 percent to about 10 percent, and is more preferably approximately 4 percent.

The difference in feed yarn spinning speeds of about 700 to 1000 meters per minute has been found to be necessary to create enough orientation difference between the two feed yarns to give the spun-like appearance desired while avoiding excessive orientation difference which would otherwise leave one end so underdrawn as to reduce crimp stability to an undesirable level.

The fully-drawn, first component of the resulting textured composite yarn has normal or low crimp frequency and good bulk. The underdrawn, second component yarn has somewhat higher crimp frequency, low bulk, and is longer than the first component yarn. This difference in length accounts for the formation of protruding yarn and filament loops which give a spun-like appearance to the resulting yarn. The preferred process provides a yarn having no broken filaments and no reversing helices along its length.

Entanglement of the resulting yarn is considered to be preferable in order to provide good delivery of the yarn from its takeup package and for good weaving performance while retaining the spun-like appearance of a fabric woven therefrom. Entanglement reduces the size of slubs in the yarn, giving fabrics woven therefrom a smoother, but still spun-like appearance. This effect of entanglement reduces appearance variability among and within yarn and fabric samples.

Dyed textile fabrics made from spun-like yarn produced by the present process have a subtle heather appearance, which probably results because the underdrawn second component yarn dyes differently from the fully drawn first component yarn.

Studies of the yarns produced by the present process show that the fully drawn first component yarn has normal or low crimp frequency, normal or high crimp amplitude, and good bulk. The underdrawn second component yarn has higher crimp frequency, low crimp amplitude, low bulk, and is longer than the first component yarn. The longer component yarn protrudes from the yarn bundle in a sinusoidal manner and does not tend to wrap around the first component yarn. The length difference results in the formation of loops which give the spun-like appearance to the yarn. The unentangled textured yarn has a loose or open structure, with few tight places and no obvious reversing helices. The entangled yarn is pinched together at irregular intervals averaging about one centimeter apart, with the tight spots averaging about 2 millimeters in length.

When the combination yarn of the present invention is stressed, the shorter, fully drawn first component yarn end carries the initial load during breaking tests. As loads increase to near the breaking point, the longer, underdrawn second component yarn end continues its drawing, permanently losing some or all of its crimp. This uneven sharing of loads presents two Instron peaks during tension testing of the combination or composite yarn. The first and larger peak represents the breaking load of the fully drawn first component yarn or ply. Entanglement appears to have little effect on physical properties of the composite yarn except for increasing denier slightly.

Tenacity as used herein is defined as the maximum stress on the composite yarn divided by the total denier. Since most of the stress is borne by the shorter, fully drawn first component yarn and the denier includes both components, yarn weaker than ordinary textured yarn of equal denier predictably results, as in a core and effect yarn.

The following examples are illustrative of the present process.

EXAMPLE I

Figure 2:
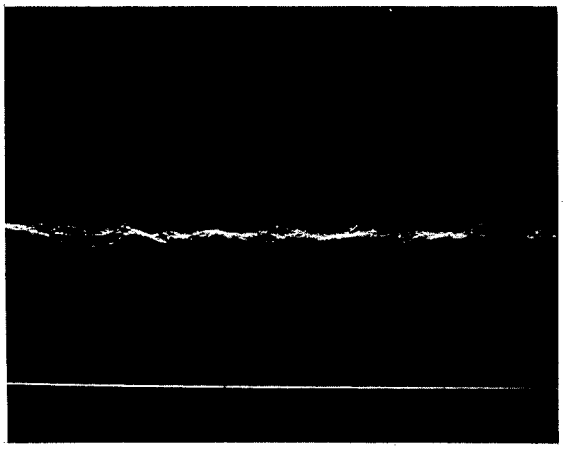

A first component yarn comprising 100/17 denier partially drawn polyethylene terephthalate yarn spun at 2735 meters per minute and a second component yarn comprising 100/17 denier partially drawn polyethylene terephthalate yarn spun at 1800 meters per minute were fed together by the input feed roll system of a Scragg SDS-II friction texturing machine using Scragg Positorq friction aggregates or friction twist units through a primary heater, and thence through a cooling zone to a friction twist unit. The combined and twisted yarn was withdrawn from the friction unit by an intermediate feed roll system and was directed therefrom through a final heater from which it was withdrawn by an output feed unit system. From the output feed unit system the twisted yarn was passed through a jet entangler, a yarn break detector and a yarn oiling system and was then wound on a takeup tube to form a yarn package. A first sample of the twisted yarn was subjected to jet entanglement intermediate the final heater and the takeup tube winder and is illustrated in FIG. 2. In a second sample of the yarn, jet entanglement was omitted. Each of the two yarn samples was woven into a 52 inch 1×2 twill fabric using twisted 150/34 untextured polyester for a warp. Each of the resulting textile fabrics was used for comparing spun-like appearance and for pilling tests after being mock-dyed and framed to 45 inches at 350° F. (176.7° C.). The draw texturing was performed under the following conditions:

friction aggregate: Scragg Positorq ® with 35.5 millimeter center spacing;

throughput speed: 325 ±5 meters per minute;

D/Y ratio (peripheral speed of twisting device/linear yarn speed): 1.71;

draw ratio: 1.984;

stabilizing overfeed: 4 percent;

takeup tension: 40 ±15 grams produced by −0.3 percent takeup underfeed;

traverse rate at takeup: 170 cycles per minute;

primary heater temperature: 210° C.;

final heater temperature: 230° C.;

entangling: air jet entangler at 30 psig;

spinning speed difference: 935 meters per minute.

The entangled and unentangled yarns each provided a woven fabric having a spun-like appearance. The unentangled yarn sample provided fair quilling and weaving performance while the quilling and weaving performance of the entangled yarn sample was good. Pilling of the textile fabric woven from the entangled yarn sample ranged between a total absence of pilling to an acceptable level. The relative crimp stability of both yarn samples was considered to be fair. The resulting entangled yarn was 110/34 denier. The breaking load of the first component yarn or ply was 233 grams while the tenacity of the composite yarn was 2.0 grams per denier. Elongation was determined to be 20 percent and the Leesona skein shrinkage was 9.0 percent.

EXAMPLE II

Figure 3:
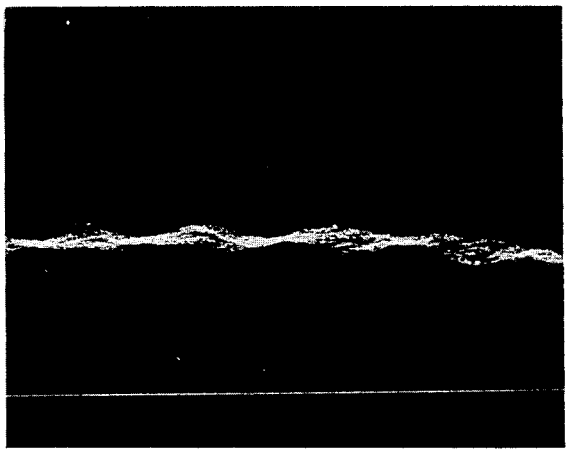

A first component yarn comprising 290/34 denier partially drawn polyethylene terephthalate yarn spun at 2735 meters per minute and having a birefringence of 0.027 and a second component yarn comprising 260/34 denier partially drawn polyethylene terephthalate yarn spun at 1800 meters per minute and having a birefringence of 0.011 were fed together through a Scragg SDS-II friction texturing machine under the same conditions recited in Example I. As in Example I, a first sample of the twisted yarn was subjected to jet entanglement intermediate the final heater and the takeup tube and is illustrated in FIG. 3. In a second sample of the yarn, jet entanglement was omitted. Each of the two yarn samples was woven into a 52 inch 1×2 twill fabric using twisted 150/34 untextured polyester for a warp. Each of the resulting textile fabrics was used for comparing spun-like appearances and for pilling tests after being mock dyed and framed to 45 inches at 350° F. (176.7° C.) The draw texturing of the yarn was performed as described in Example I. The entangled and unentangled yarns each provided a woven fabric having a good spun-like appearance. The unentangled yarn sample provided poor quilling and weaving performance while the quilling and weaving performance of the entangled yarn sample was good. Pilling of the textile fabric woven from the entangled textured yarn sample ranged between acceptable and unacceptable levels. The relative crimp stability of both yarn samples was considered to be fair. The resulting entangled yarn was 294/68 denier. The breaking load of the first component yarn or ply was 692 grams, while the tenacity of the composite yarn was 2.3 grams per denier. Elongation was determined to be 21 percent and the Leesona skein shrinkage was 9.4 percent.

EXAMPLE III

Figure 4:
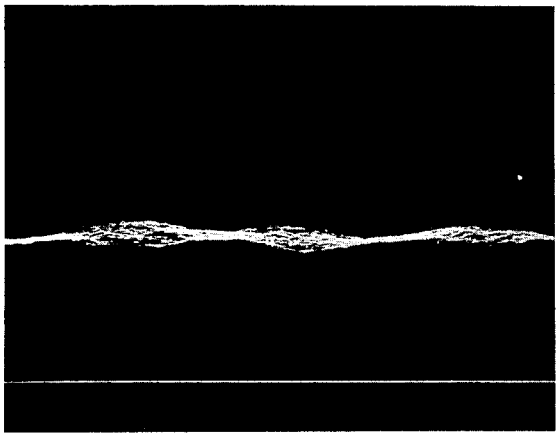

A first component yarn comprising 290/34 denier partially drawn polyethylene terephthalate yarn spun at 2735 meters per minute and having a birefringence of 0.027 and a second component yarn comprising 355/34 denier partially drawn polyethylene terephthalate yarn spun at 2200 meters per minute and having a birefringence of 0.018 were fed together through a Scragg SDS-II friction texturing machine under the same conditions recited for Example I except that the spinning speed difference between the first and second component yarns was 535 meters per minute. As in Example I, a first sample of the twisted yarn was subjected to jet entanglement, as shown in FIG. 4, while jet entanglement was omitted from a second sample of the yarn. Each of the two yarn samples was woven into a 52 inch 1×2 twill fabric using twisted 150/34 untextured polyester for a warp. The resulting textile fabrics were used for comparing spun-like appearances and for pilling tests after being mock dyed and framed to 45 inches at 350° F. (176.7° C.). The draw texturing of the yarn was performed as described in Example I. The entangled and unentangled yarns each provided a woven fabric having no spun-like appearance. However, both the unentangled and entangled yarn samples provided good quilling and weaving performance. Pilling of the textile fabric from the entangled yarn sample ranged between a total absence of pilling to an acceptable level of pilling. The relative crimp stability of the yarn samples was considered to be fair. The resulting entangled yarn was 279/68 denier. The breaking load of the first component yarn or ply was 944 grams while the tenacity of the composite yarn was 3.4 grams per denier. Elongation was determined to be 22 percent and the Leesona skein shrinkage was 8.1 percent.

EXAMPLE IV

Figure 5:
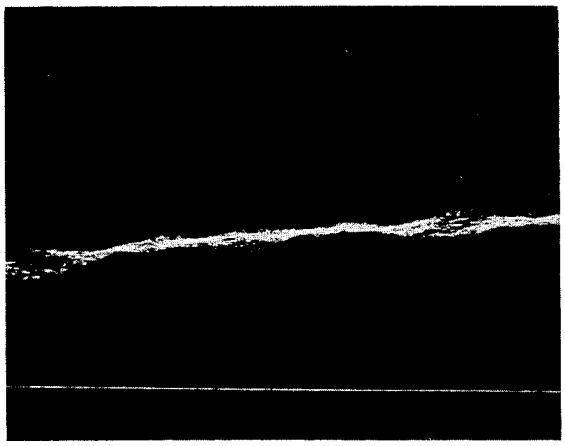

A first component yarn comprising 280/34 denier partially drawn polyethylene terephthalate yarn spun at 2735 meters per minute and having a birefringence of 0.030 and a second component yarn comprising 260/34 denier partially drawn polyethylene terephthalate yarn spun at 2500 meters per minute and having a birefringence of 0.025 were fed together through a Scragg SDS-II friction texturing machine under the same conditions recited in Example I except that the spinning speed difference between the first and second component yarns was 235 meters per minute. As in Example I, a first sample of the twisted yarn was subjected to jet entanglement, as shown in FIG. 5, while a second sample of the yarn was not subjected to such jet entanglement. Each of the two yarn samples was woven into a 52 inch 1×2 twill fabric using twisted 150/34 untextured polyester yarn for a warp. Each of the resulting textile fabrics was used for comparing spun-like appearances and for pilling tests after being mock dyed and framed to 45 inches at 350° F. (176.7° C.). The draw texturing of the yarn was performed as described in Example I. The entangled and unentangled yarns each provided a woven fabric having low spun-like appearance. The unentangled yarn sample provided poor quilling and weaving performance while the entangled sample provided good quilling and weaving performance. Pilling of the textile fabric woven from the entangled yarn sample ranged between an acceptable level of pilling and a total absence of pilling. The relative crimp stability was considered to be fair. The resulting entangled yarn sample was 347/68 denier. The breaking load of the first component yarn or ply was 882 grams while the tenacity of the composite yarn was 2.5 grams per denier. Elongation was determined to be 20 percent and the Leesona skein shrinkage was 8.5 percent.

EXAMPLE V

Figure 6:
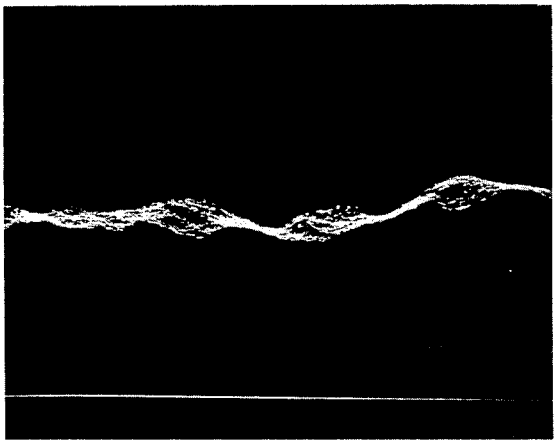

A first component yarn comprising 355/34 denier partially drawn polyethylene terephthalate yarn spun at 2200 meters per minute and having a birefringence of 0.018 and a second component yarn comprising 260/34 denier partially drawn polyethylene terephthalate yarn spun at 1800 meters per minute and having a birefringence of 0.011 were fed together through a Scragg SDS-II friction texturing machine under the same conditions recited in Example I except that the spinning speed difference between the first and second component yarns was 400 meters per minute. As in Example I, a first sample of the twisted yarn was subjected to jet entanglement, as shown in FIG. 6, while a second sample of the yarn was not subjected to such jet entanglement. Each of the two yarn samples was woven into a 52 inch 1×2 twill fabric using twisted 150/34 untextured polyester for a warp. Each of the resulting textile fabrics was used for comparing spun-like appearances and for pilling tests after being mock dyed and framed to 45 inches at 350° F. (176.7° C.). The draw texturing of the yarn was performed as described in Example I except that the draw ratio was increased from 1.984 to 2.294. The entangled and unentangled yarns each provided a woven fabric having no spun-like appearance. The unentangled yarn sample exhibited fair quilling and weaving performance, while the entangled yarn sample provided good quilling and weaving performance. Pilling of the textile fabric woven from the entangled yarn sample ranged between an acceptable level of pilling and a total absence of pilling. The relative crimp stability of the yarn samples was considered to be slightly better than fair. The resulting yarn samples were 277/68 denier. The breaking load for the first component yarn was 829 grams while the tenacity of the composite yarn was 2.8 grams per denier. Elongation was determined to be 20 percent and the Leesona skein shrinkage was 9.6 percent.

EXAMPLE VI

Figure 7:
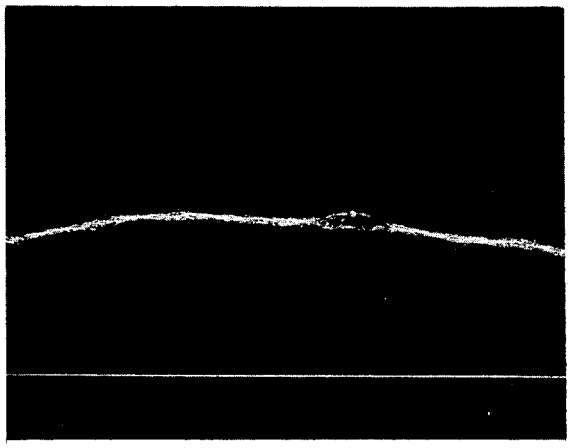

A first component yarn comprising 150/17 denier partially drawn polyethylene terephthalate yarn spun at 2735 meters per minute and a second component yarn comprising 150/17 denier partially drawn polyethylene terephthalate yarn spun at 1800 meters per minute were plied together through a Scragg SDS-II friction texturing machine under the conditions recited in Example I. As in Example I, both entangled and unentangled resulting composite yarn samples were formed and each sample was woven into a 52 inch 1×2 twill fabric using twisted 150/34 untextured polyester for a warp, which fabrics were mock dyed, framed and tested as described in Example I. The entangled yarn, as shown in FIG. 7, and the unentangled yarn each provided a woven textile fabric having a spun-like appearance. The unentangled yarn sample provided fair quilling and weaving performance while the quilling and weaving performance of the entangled yarn sample was good. Pilling of the textile fabric woven from the entangled yarn sample ranged between a total absence of pilling to an acceptable level of pilling. The relative crimp stability of both yarn samples was fair. The resulting yarns were 161/34 denier. The breaking load of the first component yarn or ply was 449 grams while the tenacity of the composite yarn was 2.8 grams per denier. Elongation was determined to be 29 percent and the Leesona skein shrinkage was 13.3 percent.

While the examples illustrate the utilization of the present process with polyethylene terephthalate yarns, it is recognized that the substitution of other thermoplastic friction-twist texturable yarns can also be used with corresponding good results. Such yarns can be used in combination with polyethylene terephthalate or in other combinations.

While the invention has been described more particularly with reference to the preferred embodiments, it is recognized that various changes can be made without departing from the spirit and scope of the invention as defined and limited only by the following claims.

What is claimed is:

1. A continuous multifilament yarn, a predetermined length of said yarn comprising:

a first component yarn having a least one first simultaneously draw textured filament, each first filament having a first crimp amplitude, a first crimp frequency and a first length;

a second component yarn having at least one second simultaneously draw textured filament, each second filament having a second crimp amplitude, a second crimp frequency and a second length, said second crimp amplitude being less than said first crimp amplitude, said second crimp frequency being greater than said frist crimp frequency, and said second length being greater than said first length; and said second component yarn being distributed along and about said first component yarn substantially free of any reversing helices of said second component yarn whereby said continuous multifilament yarn formed thereby exhibits the effective appearance of a yarn spun from staple fibers.

2. A yarn as defined in claim 1 wherein:

said first component yarn comprises a plurality of said first simultaneously draw textured filaments; and said first and second component yarns are entangled.

3. A yarn as defined in claim 1 wherein:

said second component yarn comprises a plurality of said second simultaneously draw textured filaments; and said first and second component yarns are entangled.

4. A yarn as defined in claim 1 wherein:

said first component yarn comprises a plurality of said first simultaneously draw textured filaments;

said second component yarn comprises a plurality of said second simultaneously draw textured filaments;

said first and second component yarns are entangled; and said entangled first and second yarns are heat-set.

5. A yarn as defined in claim 1 wherein:

the simultaneously draw textured filaments of said first and second component yarns are formed of melt-spinnable polymer material.

6. A yarn as defined in claim 1 wherein:

the simultaneously draw textured filaments of said first and second component yarns are formed of the same type of melt-spinnable polymer.

7. A yarn as defined in claim 1 wherein:

the simultaneously draw textured filaments of said first and second component yarns are formed of a melt-spinnable polymer selected from the group consisting essentially of polyesters, polyamides, polyolefins and mixtures thereof.

8. A yarn as defined in claim 1 wherein:

the simultaneously draw textured filaments of said first and second component yarns are formed of polyethylene terephthalate.

9. A yarn as defined in claim 1 wherein:

the simultaneously draw textured filaments of said first and second component yarns are formed of the same type of melt-spinnable polymer, the molecular orientation of said at least one first simultaneously draw textured filament being different from the molecular orientation of said at least one second simultaneously draw textured filament.

10. A yarn as defined in claim 9 wherein:

said at least one first simultaneously draw textured filament has a birefringence ranging from about 0.018 to about 0.030;

said at least one second simultaneously draw textured filament has a birefringence ranging from about 0.011 to about 0.025; and the birefringence of said at least one first simultaneously draw textured filament is at least 0.005 greater than the birefringence of said at least one second simultaneously draw textured filament.

11. A yarn as defined in claim 9 wherein:

said at least one first simultaneously draw textured filament is produced at a spinning speed in the range from about 2200 meters per minute to about 3200 meters per minute;

said at least one second simultaneously draw textured filament is produced at a spinning speed in the range from about 1800 meters per minute to about 2500 meters per minute; and the spinning speed of said at least one first simultaneously draw textured filament is at least 235 meters per minute greater than the spinning speed of said at least one second simultaneously draw textured filament.

12. A yarn as defined in claim 9 wherein said first component yarn has a denier in the range from about 100 to about 355; and said second component yarn has a denier in the range from about 100 to about 355.

13. A yarn as defined in claim 9 wherein:

said continuous multifilament yarn has a denier in the range of from about 110 to about 347.

14. A yarn as defined in claim 9 wherein:

said at least one first simultaneously draw textured filament has a birefringence of approximately 0.027;

said at least one second simultaneously draw textured filament has a birefringence of approximately 0.011;

said at least one first simultaneously draw textured filament is produced at a spinning speed of approximately 2735 meters per minute;

said at least one second simultaneously draw textured filament is produced at the spinning speed of approximately 1800 meters per minute;

said first component yarn has a denier of approximately 290;

said second component yarn has a denier of approximately 260; and said continuous multifilament yarn has a denier in the range of from about 285 to about 294.

15. A yarn as defined in claim 1 wherein:

the simultaneously draw textured filaments of said first and second component yarns are formed of a melt-spinnable polymer of the same type;

said first component yarn is fully drawn; and said second component yarn is partially drawn.

16. A textile fabric comprising a plurality of yarns, said plurality of yarns comprising:

at least one continuous multifilament yarn, a predetermined length of said yarn including:

a first component yarn having at least one first simultaneously draw textured filament, each first filament having a first crimp amplitude, a first crimp frequency and a first length;

a second component yarn having at least one second simultaneously draw textured filament, each second filament having a second crimp amplitude, a second crimp frequency and a second length, said second crimp amplitude being less than said first crimp amplitude, said second crimp frequency being greater than said first crimp frequency, and said second length being greater than said first length; and said second component yarn being distributed along and about said first component yarn substantially free of any reversing helices of said second component yarn whereby said continuous multifilament yarn formed thereby exhibits the effective appearance of a yarn spun from staple fibers, and said fabric exhibits a spun-like appearance.

17. A fabric as defined in claim 16 wherein:

said first component yarn comprises a plurality of said first simultaneously draw textured filaments; and said first and second component yarns are entangled.

18. A fabric as defined in claim 16 wherein:

said second component yarn comprises a plurality of said second simultaneously draw textured filaments; and said first and second component yarns are entangled.

19. A fabric as defined in claim 16 wherein:

said first component yarn comprises a plurality of said first simultaneously draw textured filaments;

said second component yarn comprises a plurality of said second simultaneously draw textured filaments;

said first and second component yarns are entangled; and said entangled first and second yarns are heat-set.

20. A fabric as defined in claim 16 wherein:

the simultaneously draw textured filaments of said first and second component yarns are formed of melt-spinnable polymer material.

21. A fabric as defined in claim 16 wherein:

the simultaneously draw textured filaments of said first and second component yarns are formed of the same type of melt-spinnable polymer.

22. A fabric as defined in claim 16 wherein:

the simultaneously draw textured filaments of said first and second component yarns are formed of a melt-spinnable polymer selected from the group consisting essentially of polyesters, polyamides, polyolefins and mixtures thereof.

23. A fabric as defined in claim 16 wherein:

the simultaneously draw textured filaments of said first and second component yarns are formed of polyethylene terephthalate.

24. A fabric as defined in claim 16 wherein:

the simultaneously draw textured filaments of said first and second component yarns are formed of the same type of melt-spinnable polymer, the molecular orientation of said at least one first simultaneously draw textured filament being different from the molecular orientation of said at least one second simultaneously draw textured filament.

* * * * *